United States Patent [19]

Kasai

[11] Patent Number: 4,891,866

[45] Date of Patent: Jan. 9, 1990

[54] BUCKLE OF SYNTHETIC RESIN

[75] Inventor: Kazumi Kasai, Namerikawa, Japan

[73] Assignee: Yoshida Kogyo K. K., Tokyo, Japan

[21] Appl. No.: 230,436

[22] Filed: Aug. 10, 1988

[30] Foreign Application Priority Data

Aug. 11, 1987 [JP] Japan ..... 62-122883[U]

[51] Int. Cl.[4] ..... A44B 11/12

[52] U.S. Cl. ..... 24/170; 24/191; 24/308

[58] Field of Search ..... 24/170, 191, 308, 578, 24/192, 193, 68 CD, 68 A, 134 R, 68 E

[56] References Cited

U.S. PATENT DOCUMENTS

| | | | |
|---|---|---|---|
| 2,916,786 | 12/1959 | Legat | 24/170 |
| 3,608,158 | 9/1971 | Bengtsson . | |
| 3,608,159 | 9/1971 | Brucker . | |
| 4,631,784 | 12/1986 | Fildan | 24/170 |

FOREIGN PATENT DOCUMENTS

| | | | |
|---|---|---|---|
| 0186810 | 7/1986 | European Pat. Off. . | |
| 2902553 | 7/1980 | Fed. Rep. of Germany . | |
| 1429363 | 1/1966 | France . | |
| 61-102109 | 6/1986 | Japan . | |
| 61-102110 | 6/1986 | Japan . | |
| 144888 | 4/1931 | Switzerland | 24/191 |
| 1405502 | 9/1975 | United Kingdom | 24/308 |

*Primary Examiner*—James R. Brittain

*Attorney, Agent, or Firm*—Hill, Van Santen, Steadman & Simpson

[57] ABSTRACT

A buckle comprises a base plate, a locking hook, and a retainer which are simultaneously molded of polymeric organic synthetis resin. The base plate includes a pair of spaced support members having respective bearing holes and respective ridges on inner surfaces thereof. Similarly, the retainer includes a pair of spaced support members having respective bearing holes and respective ridges on inner surfaces thereof. The locking hook has pairs of support shafts on opposite ends thereof which are angularly movably fitted in the bearing holes of the base plate and the retainer. The locking hook also has a pair of legs on the opposite ends thereof, the legs having respective successions of teeth at their respective distal edges and opposite ends engageable with the ridges on the support members of the base plate and the retainer.

5 Claims, 4 Drawing Sheets

BUCKLE OF SYNTHETIC RESIN

BACKGROUND OF THE INVENTION

1. Field of the Invention

The present invention relates to a buckle which is composed of various components that are simultaneously molded of polymeric organic synthetic resin.

2. Description of the Prior Art

U.S. Pat. No. 3,608,158 discloses a buckle of synthetic resin comprising a base plate having a pair of side flanges with respective bearing holes, and a locking hook having a pair of pivot pins fitted respectively in the bearing holes. The base plate and the locking hook are separately molded by injection molding, and they are combined together by putting the pivot pins respectively into the bearing holes.

Another buckle of synthetic resin disclosed in each of Japanese Laid-Open Utility Model Publications Nos. 61-102109 and 61-102110 also comprises a base plate and a locking hook. The base plate and the locking hook are however simultaneously injection-molded in a single mold while they are placed substantially in a plane with pivot pins on the base plate being fitted respectively in bearing holes in the locking hook. Since the buckle is molded in a single process, it is not necessary to combine or assemble the base plate and the locking hook at a later time.

With the known buckles referred to above, the difference between the inside diameter of the bearing holes and the outside diameter of the pivot pins is selected to be considerably larger for manufacturing reasons than would be if the pivot pins were closely fitted in the bearing holes. Since there is a relatively large gap between the base plate and the locking hook, therefore, the locking hook tends to wobble laterally with respect to the base plate. As a result, when a belt coupled to the buckle is fastened, belt ends coming together, one over the other, across the buckle are liable to be positionally displaced, making the fastened belt unsightly.

SUMMARY OF THE INVENTION

It is an object of the present invention to provide a buckle comprising a plurality of components which are simultaneously molded of synthetic resin, the buckle serving as a belt fastener that allows a belt coupled thereto to be positionally aligned at its opposite ends across the buckle so that the belt fastened by the buckle is made sightly.

According to the present invention, there is provided a buckle of polymeric organic synthetic resin comprising: a base plate including a substantially flat base having an engaging tooth at one end thereof and a pair of spaced support members disposed on the base at respective sides thereof, the support members having respective bearing holes defined therein, and respective ridges disposed on respective inner confronting surfaces thereof; and a locking hook including a substantially flat base having a leg projecting substantially perpendicularly therefrom at one end thereof and extending fully across the one end, the leg having opposite ends engageable with the ridges, respectively, when the locking hook is turned down against the base plate, the leg having a succession of teeth on a distal edge thereof, and a pair of support shafts projecting from opposite sides of the base and angularly movably fitted respectively in the bearing holes, the base plate and the locking hook being simultaneously molded as a single assembly with the support shafts fitted respectively in the bearing holes.

The buckle further includes a retainer including a substantially flat base having an engaging tooth at one end thereof and a pair of second spaced support members disposed on the base at respective sides thereof, the second support members having respective second bearing holes defined therein, and respective second ridges disposed on respective inner confronting surfaces thereof, the base of the locking hook having a second leg projecting substantially perpendicularly therefrom in the opposite end thereof remote from the first-mentioned leg and extending fully across the opposite end, the second leg having opposite ends engageable with the second ridges, respectively, when the retainer is turned down against the locking hook, the second leg having a succession of teeth on a distal edge thereof, and a pair of second support shafts projecting from opposite sides of the base of the locking hook and angularly movably fitted respectively in the second bearing holes, the base plate, the locking hook, and the retainer being simultaneously molded as a single assembly with the second support shafts fitted respectively in the second bearing holes.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION

Figure 1:
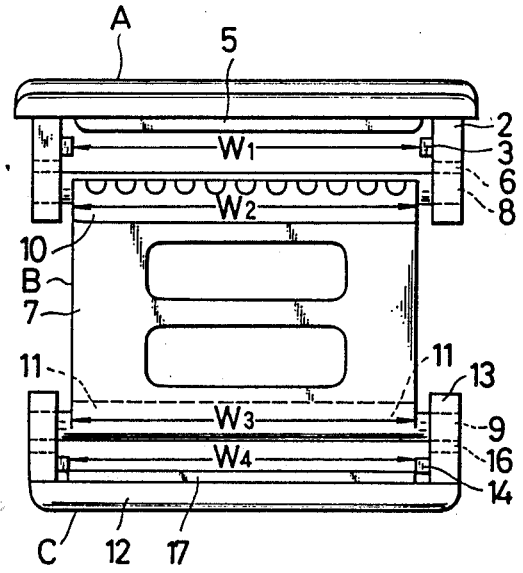
FIG. 1 a front elevational view of a buckle according to an embodiment of the present invention.
Figure 2:
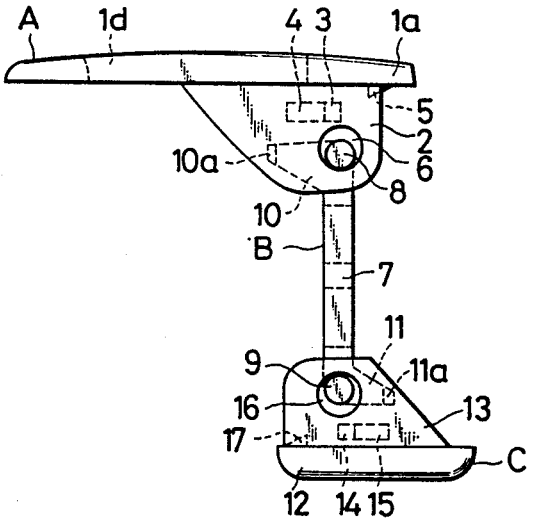
FIG. 2 is a side elevational view of the buckle shown in FIG. 1.

FIGS. 1 and 2 show a buckle according to an embodiment of the present invention, the buckle comprising a base plate A, a locking hook B, and a retainer C.

Figure 3:
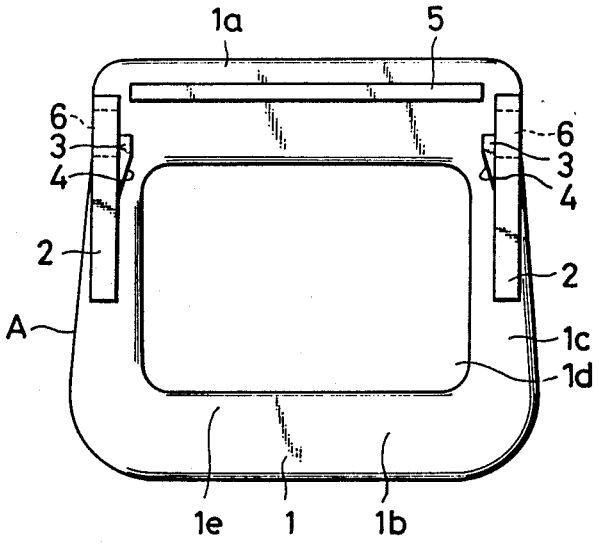
FIG. 3 is a rear elevational view of a base plate of the buckle of FIG. 1.

As also shown in FIG. 3, the base plate A comprises a substantially flat rectangular base 1 having a central through hole 1*d*. The base 1 includes an upper transverse member 1*a* at an upper end, a lower transverse member 1*b* at a lower end remote from the upper transverse member 1*a*, and a pair of laterally spaced side members 1*c*. These members 1*a*, 1*b*, 1*c* jointly define the hole 1*d* therebetween. The base plate A also includes a pair of laterally spaced support members 2 mounted on a rear side thereof and extending from intermediate portions of the side members 1*c* toward the upper transverse member 1*a*. The support members 2 project perpendicularly to the base 1. The support members 2 include respective confronting ridges 3 projecting on their inner surfaces and having respective slanted surfaces 4 progressively inclined toward the support members 2 in a direction away from the upper transverse member 1*a*. A narrow engaging tooth 5 of triangular cross section is disposed on the rear side of the upper transverse member 1*a*, the engaging tooth 5 extending along the upper transverse member 1*a* substantially the full length thereof. The support members have respective circular bearing holes 6 defined therein near the engaging tooth 5.

Figure 4:
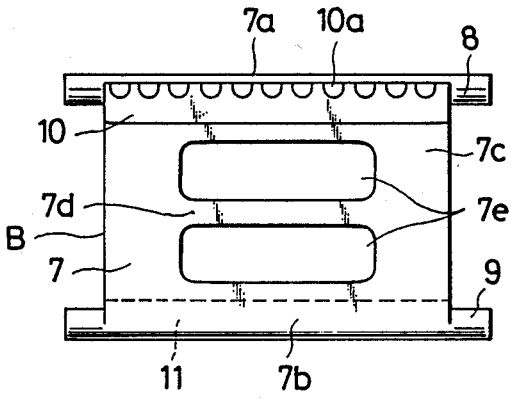
FIG. 4 is plan view of a locking hook of the buckle of FIG. 1.

As illustrated in FIGS. 1, 2, and 4, the locking hook B comprises a substantially flat rectangular base 7 including an upper transverse member 7*a* at an upper end, a lower transverse member 7*b* at a lower end, a pair of laterally spaced side members 7*c*, and an intermediate transverse member 7*d* extending between and joined to the side members 7*c* with a pair of through holes 7*e* defined between these members 7*a*, 7*b*, 7*c*, 7*d*. The locking hook B also includes a pair of upper support shafts or pivot pins 8 projecting away from each other from the laterally opposite end of the upper transverse member 7*a*, and a pair of lower support shafts or pivot pins 9 projecting away from each other from the laterally opposite ends of the lower transverse member 7*b*. As better shown in FIG. 2, a first upper leg 10 is disposed on the rear surface of the upper transverse member 7*a* and extends along the entire length thereof, the upper leg 10 projecting substantially perpendicularly from the base 7 in one direction. The upper leg 10 has a succession of teeth 10*a* disposed on its distal end and each extending transversely across the distal end. The teeth 10*a* may be in the form of serrations, surface irregularities, or a knurled surface. A second lower leg 11 is disposed on the front surface of the lower transverse member 7*b* and extends along the entire length thereof, the lower leg 11 projecting substantially perpendicularly from the base 7 in the direction opposite to the upper leg 10. The lower leg 11 has a succession of teeth 11*a* disposed on its distal end and each extending transversely across the distal end. The teeth 11*a* may also be in the form of serrations, surface irregularities, or a knurled surface.

Figure 5:
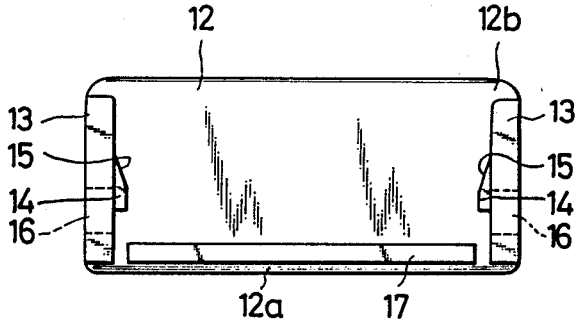
FIG. 5 is a plan view of a retainer of the buckle of FIG. 1.

As shown in FIGS. 1, 2, and 5, the retainer C comprises a substantially flat rectangular base 12 including a pair of opposite transverse edges 12*a*, and a pair of laterally spaced side edges 12*b*. A pair of support members 13 is disposed on the rear surfaces of the respective side edges 12*b*, the support members 13 projecting perpendicularly from the base 13. The support members 13 include respective confronting ridges 14 projecting on their inner surfaces and having respective slanted surfaces 15 progressively inclined toward the support members 13 in a direction away from upper the transverse edge 12*a*. The support members 13 have respective circular bearing holes 16 defined therein near the transverse edge 12*a*. A narrow engaging tooth 17 of triangular cross section is disposed on the rear side of the transverse edge 12*a*, the engaging tooth 17 extending between the support members 13 along the transverse edge 12*a* substantially the full length thereof.

As shown in FIG. 1, the distance $W_1$ between the confronting surfaces of the ridges 3 of the base plate A, the length $W_2$ of the leg 10 of the locking hook B, the length $W_3$ of the leg 11 of the locking hook B, and the distance $W_4$ between the inner confronting surfaces of the ridges 14 of the retainer C are substantially the same as each other. In the illustrated embodiment, each of the bearing holes 6, 16 has an inside diameter of 3.5 mm, and each of the support shafts 8, 9 has an outside diameter of 2.5 mm. However, bearing holes 6, 16 and the support shafts 8, 9 are not limited to these dimensions.

The base plate A, the locking hook B, and the retainer C are simultaneously molded, as by injection molding, of polymeric organic synthetic resin such as polyamides, polyacetals, or the like. More specifically, a single mold has a mold cavity which is complementary in shape to the base plate A, the locking hook B, and the retainer C which are assembled as shown in FIG. 2, and the mold is set in an injection molding machine or the like. The material is then injected into the mold for forming the buckle assembly as shown in FIG. 2 in a single molding process. Therefore, the buckle shown in FIG. 2 with the support shafts 8 fitted in the the bearing holes 6 and the support shafts 9 in the bearing holes 9 is molded at one time. Since the base plate A, the locking hook B, and the retainer C as they are molded are already assembled or combined together, it is not necessary to put them together at a later time.

Figure 6:
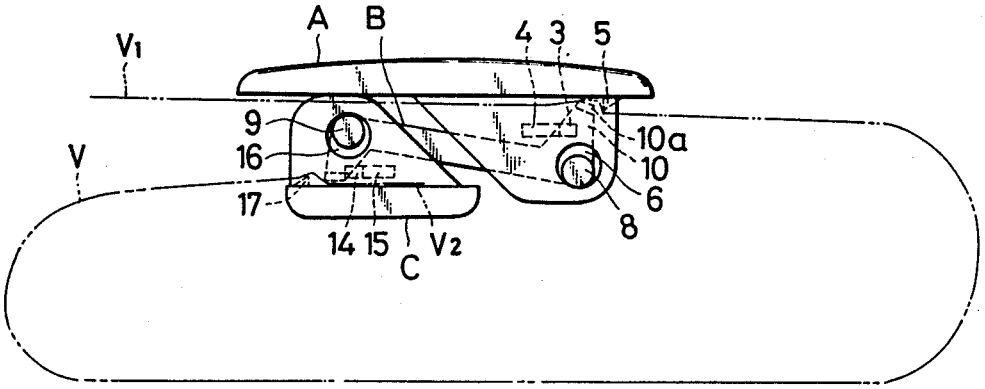
FIG. 6 is a side elevational view of the buckle of FIG. 1 with a belt fastened thereby.
Figure 7:
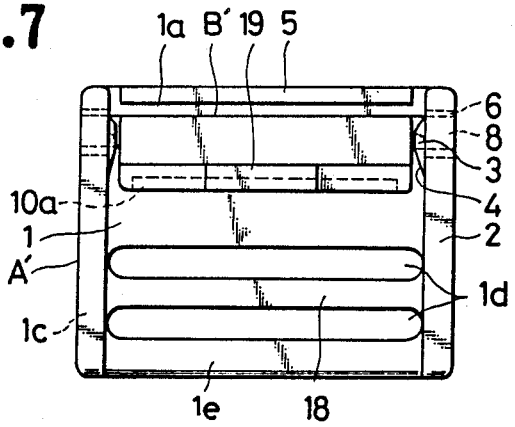
FIG. 7 is a plan view of a buckle according to another embodiment of the present invention.
Figure 8:
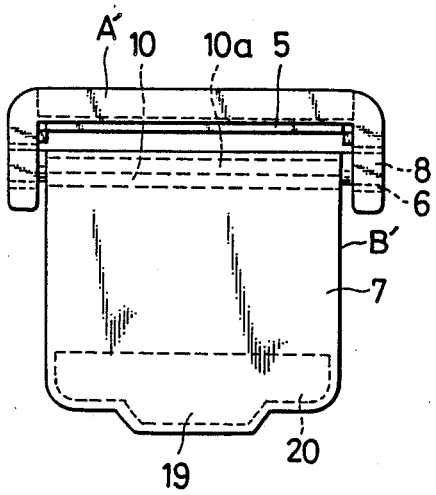
FIG. 8 is a front elevational view of the buckle illustrated in FIG. 7.
Figure 9:
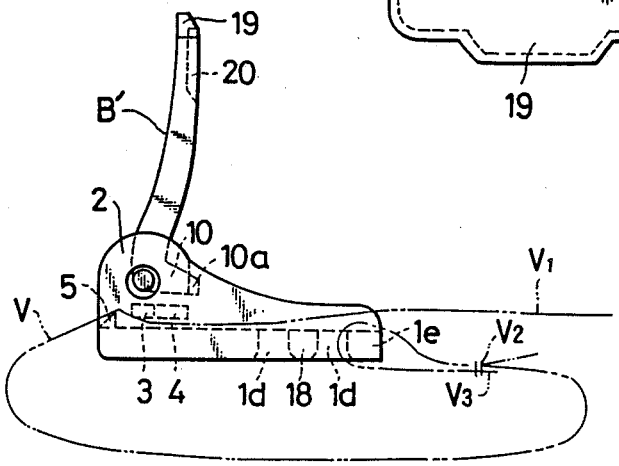
FIG. 9 is a side elevational view of the buckle of FIG. 7 with a belt fastened thereby.

FIGS. 7, 8, and 9 illustrate a buckle according to another embodiment of the present invention. Those parts which correspond to those shown in FIGS. 1 through 6 are denoted by corresponding reference characters.

The buckle shown in FIGS. 7, 8, and 9 comprises a base plate A′ and a locking hook B′. The base plate A′ shown in FIG. 7 is basically the same as the base plate A shown in FIG. 3 except that a transverse member 18 extends between and is joined to the side members 1*c* with a pair of holes 1*d* defined one on each side of the transverse member 18. The locking hook B′ shown in FIG. 8 differs from the locking hook B of FIG. 4 in that the locking hook B′ does not have support shafts 9 and a leg 11, but has a grip 19 on an end thereof remote from the leg 10. The grip 19 has a recess 20 defined in one surface thereof for putting a user's finger therein when gripping the grip 19. The buckle of FIGS. 7, 8, and 9 can be molded in the same manner as the buckle of the previous embodiment is molded.

The buckle shown in FIGS. 1 and 2 is used as follows: As shown in FIG. 6, the buckle may be employed as a fastener for fastening a belt V to be worn around the waist portion of a lady's garment such as a one-piece dress, for example. First, with the buckle held as shown in FIG. 2, a lefthand end of the belt V is inserted, to the right, into the retainer C vertically between the support members 13 of the retainer C and horizontally between the leg 11 of the locking hook B and the engaging tooth 17 of the retainer C. Then, as shown in FIG. 6, the belt end, denoted by $V_2$, is placed opposite to the engaging tooth 17, and while the retainer C is being held in position, the locking hook B is turned clockwise about the support shafts 9 to pinch the belt end $V_2$ between the engaging teeth 11*a* on the leg 11 and the engaging tooth 17, thus fixing the belt end $V_2$ to the retainer C. The belt V is then placed around the waist of the user, and a righthand end $V_1$ of the belt V is inserted through the base plate A vertically between the support members 2 of the base plate A and horizontally between the engaging tooth 5 of the base plate A and the leg 10 of the locking hook B while the base plate A is being held at a right angle or a smaller angle to the locking hook B. After the belt end $V_2$ is pulled tightly around the waist, the transverse member 1*e* is pressed against the user's body, i.e., the retainer C, whereupon the base plate A is turned counterclockwise about the support shafts 8. The belt V is now forcibly pinched between the engaging tooth 5 of the base plate A and the engaging teeth 10*a* of the locking hook B thus holding the belt V fastened.

As described above, the distances $W_1$, $W_4$ between inner surfaces of the ridges 3, 14 of the base plate A and the retainer C are substantially equal to the lengths $W_2$, $W_3$ of the transverse members 7*a*, 7*b* of the locking hook B. Therefore, when the belt V is fastened and locked by the buckle which is folded as shown in FIG. 6, the ridges 3, 14 engage the ends of the legs 10, 11 of the locking hook B to prevent the legs 10, 11 of the locking hook B from laterally wobbling. Even if the difference between the diameters of the bearing holes 6, 16 and the support shafts 8, 9 is large to avoid difficulty in molding the base plate A, the locking hook B, and the retainer C simultaneously in one mold, the locking hook B is not moved with respect to the base plate A and the retainer C. As a consequence, the belt end portions passing through the buckle are not positionally displaced from each other, i.e., remain aligned with each other, so that the fastened belt V is kept neatly and sightly. The locking hook B can also be positionally limited in directions across its thickness to prevent itself from wobbling in those directions by adjusting the extent of projection of the legs 10, 11. Inasmuch as the locking hook B is not displaced with respect to the base plate A and the retainer C, the belt V remains securely and reliably fastened in position. The slanted surfaces 4, 15 of the ridges 3, 14 serve to cam the locking hook B and the retainer C into a central position on the base plate A while guiding the legs 10, 11 progressively onto the ridges 3, 14. Since the legs 10, 11 do not hit the ridges 3, 14 but rather smoothly ride onto the ridges 3, 14 from the slanted surfaces 4, 15, the ridges 3, 14 are prevented from being damaged or broken by the legs 10, 11.

The buckle shown in FIGS. 7, 8, and 9 is used in substantially the same manner as described above with reference to the buckle of the previous embodiment, except that the belt end $V_2$ is either passed through one of the holes 1*d* near the edge 1*e* and folded on itself around the edge 1*e*, or passed through one of the holes 1*d* near the edge 1*e*, turned around the transverse member 18, passed through the other hole 1*d*, and folded on itself around the transverse member 18, and then finally fastened to a belt portion $V_3$ by eyelets or stitches.

Obviously, various modifications and variations of the present invention are possible in the light of the above teaching. It is therefore to be understood that within the scope of the appended claims the invention may be practiced otherwise than as specifically described.

What is claimed is:

1. A buckle of polymeric organic synthetic resin comprising:

a base plate including a substantially flat base having an engaging tooth at one end thereof and a pair of spaced support members disposed on said base at respective sides thereof, said support members having respective bearing holes defined therein, and respective ridges disposed on respective inner confronting surfaces thereof at a level between said substantially flat base and said bearing holes; and a one piece locking hook including a substantially flat base having an integral leg projecting substantially perpendicularly therefrom at one end thereof and extending fully across said one end, said leg having opposite sides engageable with said ridges, respectively, when said locking hook is turned down against said base plate, said leg having a succession of teeth on a distal edge thereof each of said teeth extending transversely across said distal edge, and a pair of support shafts projecting from opposite sides of said base of said locking hook and loosely received respectively in said bearing holes, said base plate and said locking hook being a single integral molded assembly with said support shaft fitted respectively in said bearing holes, the distance between inner confronting surfaces of said ridges being substantially the same as the length of said leg across said one end.

2. A buckle according to claim 1, wherein said ridges have respective slanted surfaces progressively inclining toward said support members in a direction away from said one end of said base plate for allowing said opposite ends of said leg to slide thereover into engagement with said ridges.

3. A buckle of polymeric organic synthetic resin comprising:

a base plate including a substantially flat base having an engaging tooth at one end thereof and a pair of spaced support members disposed on said base at respective sides thereof, said support members having respective bearing holes defined therein, and respective ridges disposed on respective inner confronting surfaces thereof;

a locking hook including a substantially flat base having a leg projecting substantially perpendicularly therefrom at one end thereof and extending fully across said one end, said leg having opposite sides engageable with said ridges, respectively, when said locking hook is turned down against said base plate, said leg having a succession of teeth on a distal edge thereof, and a pair of support shafts projecting from opposite sides of said base of said locking hook and loosely received respectively in said bearing holes; and a retainer including a substantially flat base having an engaging tooth at one end thereof and a pair of second spaced support members disposed on said retainer base at respective sides thereof, said second support members having respective second bearing holes defined therein, and respective second ridges disposed on respective inner confronting surfaces thereof, said base of said locking hook having a second leg projecting substantially perpendicularly therefrom in the opposite end thereof remote from said first-mentioned leg and extending fully across said opposite end, said second leg having opposite sides engageable with said second ridges, respectively, when said retainer is turned down against said locking hook, said second leg having a succession of teeth on a distal edge thereof, and a pair of second support shafts projecting from opposite sides of said base of the locking hook and loosely received respectively in said second bearing holes, said base plate, said locking hook, and said retainer being a single integral molded assembly with said second support shafts fitted respectively in said second bearing holes.

4. A buckle according to claim 3, wherein the distance between inner confronting surfaces of said second ridges is substantially the same as the length of said second leg across said opposite end.

5. A buckle according to claim 3, wherein said second ridges have respective slanted surfaces for allowing said opposite ends of said second leg to slide thereover into engagement with said second ridges.

* * * * *